United States Patent [19]

Treadway

[11] Patent Number: 5,024,259

[45] Date of Patent: Jun. 18, 1991

[54] GOLF CLUB RAIN SACK

[76] Inventor: C. Arthur Treadway, P.O. Box 1736, Greenville, S.C. 29607

[21] Appl. No.: 447,835

[22] Filed: Dec. 8, 1989

[51] Int. Cl.[5] ..... A63B 55/00

[52] U.S. Cl. ..... 150/159; 150/160; 206/315.4

[58] Field of Search ..... 150/159, 160; 206/315.3-315.8, 315.2; D3/37; 280/DIG. 6

[56] References Cited

U.S. PATENT DOCUMENTS

| | | | |
|---|---|---|---|
| D. 256,293 | 8/1980 | Edwards | 206/315.4 X |
| 2,471,169 | 5/1949 | Salzberg et al. | 150/159 X |
| 2,907,364 | 10/1959 | Trenery | 150/159 |
| 3,620,276 | 11/1971 | Taylor | 150/159 X |
| 3,754,587 | 8/1973 | Rainieri | 150/159 |
| 3,913,648 | 10/1975 | Sessler | 150/160 X |
| 4,453,632 | 6/1984 | Clower | 150/160 X |
| 4,474,388 | 10/1984 | Wagner | 150/159 X |
| 4,699,164 | 10/1987 | Pilney et al. | 150/160 X |

FOREIGN PATENT DOCUMENTS

| | | | |
|---|---|---|---|
| 1230580 | 5/1971 | United Kingdom | 206/315.3 |
| 1277431 | 6/1972 | United Kingdom | 206/315.3 |

*Primary Examiner*—Sue A. Weaver
*Attorney, Agent, or Firm*—Cort Flint

[57] ABSTRACT

A transparent protective hood (A) is disclosed for a golf bag (10) and clubs (12). The hood includes a back part (22) which terminates short of a front panel (20) and side vents (24, 26) for club removal around the entire bag.

10 Claims, 1 Drawing Sheet

GOLF CLUB RAIN SACK

BACKGROUND OF THE INVENTION

The invention relates to a protective cover for golf clubs carried in an open top golf club bag. In order that a golfer may grip a golf club properly, it is necessary that the golf clubs be kept dry. Dryness is also necessary to maintain the finish on the clubs to prevent rust, and to protect the interior of the bag. Golf bags often include a bag cover which attaches to the top of the bag and covers the clubs for protection during rain and the like. These covers cover the top of the bag and the clubs very tightly, and are not transparent, rendering access to the clubs difficult. The covers fit so tight that they often prevent wet bags and clubs from ventilating properly and drying. Protective covers for golf clubs and bags which are transparent so that the clubs may be readily seen and which provide convenient access to the golf clubs for use are disclosed in U.S. Pat. Nos. 4,453,632 and 3,913,648. While both devices are generally satisfactory for their intended use, both devices are fastened to the strap ring which makes access to the clubs at the back of the bag rather difficult. The device in U.S. Pat. No. 4,453,632 consists mainly of a flat sheet of material which is draped over the clubs and weighted. While this provides a very open access around most of the perimeter of the golf bag, it is often difficult to maintain it in the proper position over the clubs even with the use of weights.

Accordingly, an important object of the present invention is to provide a protective device for golf clubs in a golf bag during rain and the like which affords access to the clubs virtually around the entire perimeter of the golf bag.

Another object of the invention is to provide a device which will protect golf clubs in a golf bag which provides convenient access to the clubs around the entire perimeter of the bag, yet is securely retained over the clubs.

SUMMARY OF THE INVENTION

The above objectives are accomplished according to the present invention by providing a protective cover for golf clubs which is tailored in the form of a hood having a front panel, a back panel, and vented sides. The front panel terminates below the back panel to adequately cover the front of the bag while providing convenient access to the wood clubs at the back of the bag. Weights are carried around the free edges of the panels. While providing side vents and custom tailoring of the front and back panels in the form of a hood, no attachment to the bag is necessary and the weights allow the panels to be raised for access to the clubs while retaining the hood on the bag.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
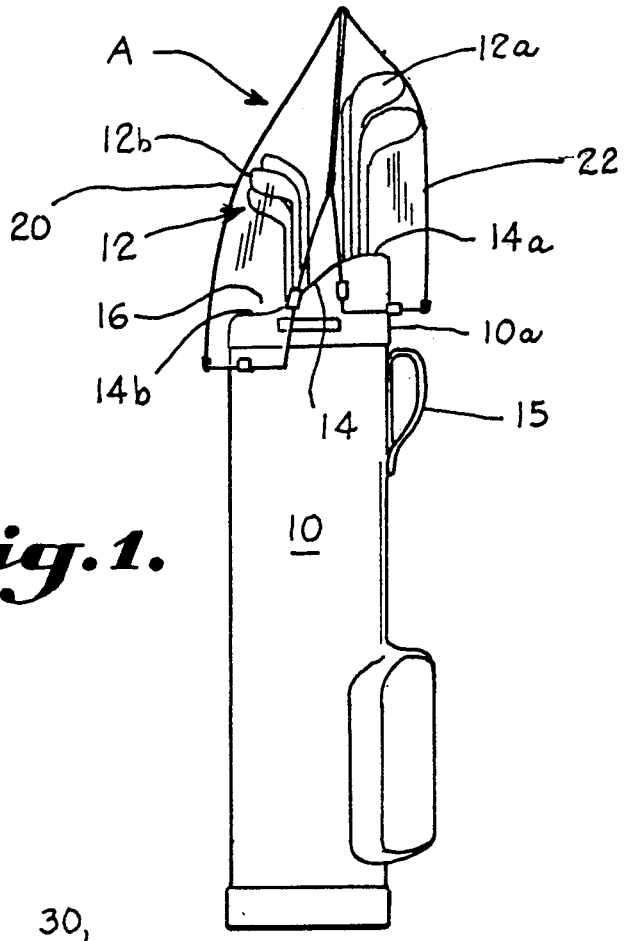
FIG. 1 is a perspective view illustrating a golf club bag and clubs fitting with a protective hood according to the invention.

Referring now in more detail to the draWings, a protective one-piece hood consisting of a front panel and a back panel, designated generally as A is illustrated for protecting a golf bag 10 and golf clubs 12 carried in the golf bag. Golf bag 10 has an upper rim 14 which defines an open top 16 from which the golf clubs are removed and replaced.

Golf bag 10 includes a back side 10*a* on which a handle 15 is carried and a generally front side 10*b*. Typically, rim 14 is higher at 14*a* at back side 10*a* of bag 10 and consequently lower at 14*b* on front side 10*b* of bag 10. Typically wood clubs 12*a* are carried in golf bag 10 at back side 10*a* of the bag, and irons 12*b* are carried toward front side 10*b* of the bag.

Figure 2:
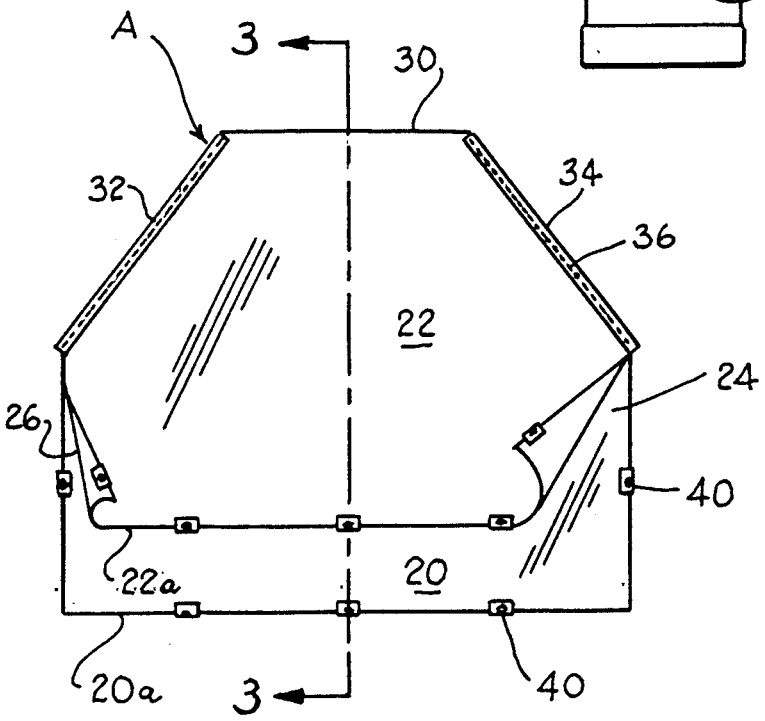
FIG. 2 is a rear elevation of a protective hood for golf clubs constructed according to the present invention.
Figure 3:
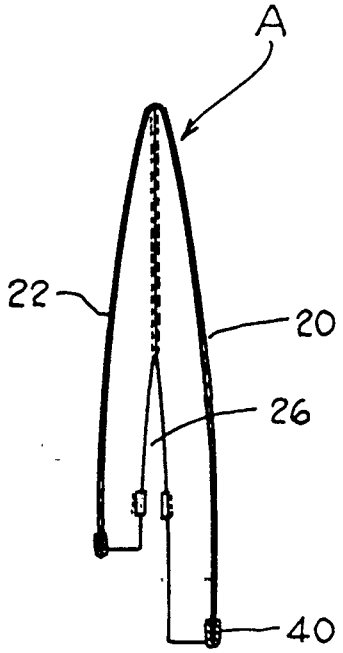
FIG. 3 is a sectional view taken along line 3—3 of FIG. 2.

As can best be seen in FIG. 2, protective hood A includes a transparent front panel 20 and a transparent back panel 22. A first side vent 24 is formed at a first side of the hood and a second side vent 26 is formed at a second side of the hood. Split vents 24 and 26 enable the hood to be lifted more conveniently for access and removal of golf clubs. Hood A has a tapering configuration which includes an upper edge 30, a first downwardly flared edge 32, and a second downwardly flared edge 34, both of which flare downwardly from upper edge 30. The upper edges so described are formed by corresponding edges of front and back panels 24 and 26 joined together by suitable joining means such as stitching 36. It is to be understood, of course, that other suitable means for joining the panels may be utilized such as thermal, chemical, etc. Front and back panel sections terminate in lower free edges 20*a* and 22*a*, respectively. Weight means in the form of individually attached weights 40 attached around the peripheral free edges 20*a* and 22*a* are provided for holding the hood in place while allowing a golfer to lift the panels of the hood for removing and replacing golf clubs.

Lower edge 20*a* of front panel 20 extends past free edge 22*a* of back panel 22. As can best be seen in FIG. 1, this enables back panel 22 to fit just over upper rim 14*a* so that excessive material is not provided for lifting to remove and replace woods 12*a* from back side 10*a* of the golf bag. At the same time, front panel 20 has a sufficient length to cover lower edge 14*b* of rim 14 and irons 12*b* in the golf bag. In this manner, both front and back panels may be conveniently lifted either from the front or back or the side vents to access golf clubs in the bag. Side vents 24 and 26 enable front and back panels to be conveniently lifted and also provide for access from the left and right sides of the golf bag to the golf clubs. As can be seen, no attachment of hood A to the golf bag is provided as in the prior art. Access to the golf clubs may be had generally around the entire perimeter of golf bag 10. Weights 40 maintain hood A over the golf clubs, yet allow lifting of the hood around its entire perimeter.

While a preferred embodiment of the invention has been described using specific terms, such description is for illustrative purposes only, and it is to be understood that changes and variations may be made without departing from the spirit or scope of the following claims.

What is claimed is:

1. A protective hood for golf clubs carried in a golf bag, said bag being of the type having a handle carried on a back side of said bag, wherein said protective hood comprises:

a hood including a front panel and a back panel;

said front panel having an upper edge and terminating in a lower free edge;

said back panel having an upper edge and terminating in a lower free edge;

means for joining said upper edges of said front and back panels together to form said hood;

a first split vent carried on a first side of said hood between said front and back panels defined by a non-closeable opening;

a second split vent carried on a second side of said hood between said front and back panels defined by a non-closeable opening; and weight means carried by said lower free edges of said front and back panels.

2. The device of claim 1 wherein said upper edges of said front and back panels include outer edges which flare downwardly from a middle portion of said upper edges.

3. The device of claim 2 wherein said middle portion of said upper edges include a first generally straight edge, and said outer edges include a second edge extending downwardly near one end of said straight edge, and a third edge extending downwardly from a second end of said straight edge.

4. The device of claim 1 wherein said means for joining said upper edges of said front and back panels include stitching said upper edges together.

5. The device of claim 1 wherein said free edge of said front panel terminates a distance past the free edge of said back panel of said hood.

6. The device of claim 1 wherein said front and back panels are transparent.

7. A protective hood for gold clubs carried in a golf bag, said bag being of the type having a handle carried on a back side of said bag, wherein said protective hood comprises:

a one-piece hood consisting of a front panel and a back panel, each said panel having an upper edge and a lower free edge;

said back panel of said hood fitting over said back side of said golf bag above said bag handle;

said front panel of said hood fitting around said front side of said golf bag;

said lower edge of said front panel extends past said lower edge of said back panel;

means joining said front and back panels together over at least a portion of said upper edges of said panels so that said panels fit together and are carried over said golf clubs without attachment to said golf bag whereby said golf clubs may be easily removed from any side of said bag; and weight means carried by said free edges of said front and back panels for allowing a user to lift said hood for removing and replacing golf clubs and for maintaining said hood in place.

8. The device of claim 8 including a first split vent formed between said front and back panels on a first side of said hood; and a second split vent formed between said front and back panels on he second side of said hood.

9. The device of claim 7 wherein said upper edge of said hood includes middle edge, a first tapering edge flared downward from said middle edge, and a second tapering edge flared downward from said middle edge.

10. The device of claim 7 wherein said front and back panels are transparent.

* * * * *